US011203498B2

(12) United States Patent
Fukumasu et al.

(10) Patent No.: US 11,203,498 B2
(45) Date of Patent: Dec. 21, 2021

(54) MEDIUM FEEDING APPARATUS AND IMAGE READING APPARATUS

(71) Applicant: SEIKO EPSON CORPORATION, Tokyo (JP)

(72) Inventors: Keiichiro Fukumasu, Fukuoka (JP); Tomoyuki Mokuo, Fukuoka (JP); Hiromichi Kitsuki, Fukuoka (JP); Tokujiro Okuno, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 260 days.

(21) Appl. No.: 16/362,881

(22) Filed: Mar. 25, 2019

(65) Prior Publication Data

US 2019/0291984 A1 Sep. 26, 2019

(30) Foreign Application Priority Data

Mar. 26, 2018 (JP) ..... JP2018-058212

(51) Int. Cl.

| | |
|---|---|
| ***B65H 5/36*** | (2006.01) |
| ***B65H 5/06*** | (2006.01) |
| ***B65H 3/06*** | (2006.01) |
| ***B65H 5/38*** | (2006.01) |

(52) U.S. Cl.

CPC ..... *B65H 5/36* (2013.01); *B65H 3/0607* (2013.01); *B65H 5/062* (2013.01); *B65H 5/38* (2013.01); *B65H 2404/54* (2013.01); *B65H 2404/741* (2013.01)

(58) Field of Classification Search

CPC ..... B65H 3/06; B65H 3/0661; B65H 3/0676; B65H 3/523; B65H 3/5284; B65H 3/66; B65H 3/68; B65H 5/06; B65H 5/062; B65H 5/36; B65H 5/38; B65H 2404/511; B65H 2404/512; B65H 2404/54; B65H 2404/74; B65H 2404/741; B65H 2404/7412; B65H 2404/62

See application file for complete search history.

(56) References Cited

U.S. PATENT DOCUMENTS

| | | | | |
|---|---|---|---|---|
| 4,928,951 | A * | 5/1990 | Fukui | B65H 3/5261 271/113 |
| 9,340,381 | B2 * | 5/2016 | Matsushita | B65H 5/068 |
| 2010/0303529 | A1 * | 12/2010 | Shiba | B65H 5/38 399/388 |
| 2018/0118486 | A1 * | 5/2018 | Lin | B65H 3/5284 |

FOREIGN PATENT DOCUMENTS

JP 2016-072833 A 5/2016

* cited by examiner

*Primary Examiner* — Prasad V Gokhale

(74) *Attorney, Agent, or Firm* — Global IP Counselors, LLP

(57) ABSTRACT

A medium feeding apparatus includes a mounting section on which a medium to be fed is mounted, a feeding roller configured to feed the medium mounted on the mounting section, a separation roller configured to nip and separate the medium with the feeding roller therebetween, and a regulation section disposed downstream of the nipping position between the feeding roller and the separation roller, the regulation section being configured to regulate the contact of the medium to be fed and the separation roller by coming into contact with the medium from the side of the separation roller.

18 Claims, 11 Drawing Sheets

MEDIUM FEEDING APPARATUS AND IMAGE READING APPARATUS

BACKGROUND

1. Technical Field

The present invention relates to a medium feeding apparatus for transporting a medium and an image reading apparatus having the medium feeding apparatus.

2. Related Art

Scanners, which are example image reading apparatuses, and printers, which are example recording apparatuses, are provided with a feeding apparatus for feeding a medium. Some feeding apparatuses employ a system for separating a medium, for example, a system for separating a medium by nipping the medium with a separation roller and a feeding roller. To the separation roller, rotation resistance or reverse rotation torque is applied. Such a feeding apparatus is described, for example, in JP-A-2016-72833.

The inventors have found that the contact between the separation roller and the medium can cause a decrease in the separation performance and provide a method for solving the problem.

SUMMARY

An advantage of some aspects of the invention is that there is provided a medium feeding apparatus capable of reducing the decrease in the separation performance and an image reading apparatus having the medium feeding apparatus.

A medium feeding apparatus according to an aspect of the invention includes a mounting section on which a medium to be fed is mounted, a feeding roller configured to feed the medium mounted on the mounting section, a separation roller configured to nip and separate the medium with the feeding roller therebetween, and a regulation section disposed downstream of the nipping position between the feeding roller and the separation roller, and the regulation section being configured to come into contact with the medium from the side of the separation roller so as to regulate the contact of the medium to be fed and the separation roller.

The inventors have found that the contact between the separation roller and the medium being fed downstream of the nipping position between the separation roller and the feeding roller can cause a decrease in the separation performance. Specifically, the inventors have found that when a medium is subjected to a feeding force from another feeding roller pair on the downstream side of the nipping position, the medium that has wound around the separation roller on the downstream side of the nipping position between the separation roller and the feeding roller can cause the separation roller to rotate in a forward direction. The rotation of the separation roller in the forward feeding direction can allow the medium not to be multi-fed to be fed downstream.

In this aspect, there is provided a regulation section disposed downstream of the nipping position between the feeding roller and the separation roller, the regulation section being disposed at a position different from the separation roller in an intersecting direction that intersects a medium feeding direction, and the regulation section being configured to regulate the contact of the medium to be fed and the separation roller. With this regulation section, on the downstream side of the nipping position between the separation roller and the feeding roller, the area in which a medium comes into contact with the separation roller can be reduced or the contact can be prevented. As a result, the rotation of the separation roller in the forward feeding direction due to the medium to be fed can be reduced, that is, the decrease in the separation performance can be reduced. The expression "regulate the contact" includes to completely prevent a medium from coming into contact with the separation roller and to reduce the contact of a medium being in contact with the separation roller.

In this medium feeding apparatus, a part of the regulation section may be within an area of the separation roller when viewed in the intersecting direction. In this structure, since at least a part of the regulation section is within an area of the separation roller when viewed in the medium width direction that intersects the medium feeding direction, at a position near the nipping position between the separation roller and the feeding roller, winding of a medium around the separation roller can be reduced. Accordingly, the winding of a medium around the separation roller can be more reliably reduced.

In the medium feeding apparatus, when the nipping position between the feeding roller and the separation roller is a first nipping position, the regulation section may be located above a tangent line at the first nipping position when viewed in the intersecting direction.

With this structure, when the nipping position between the feeding roller and the separation roller is a first nipping position, the regulation section does not protrude from a tangent line at the first nipping position toward the feeding roller side when viewed in the medium width direction that intersects the medium feeding direction. Accordingly, the occurrence of damage such as scratches due to the regulation section to a medium to be fed can be reduced.

The medium feeding apparatus may further include a feeding roller pair disposed downstream of the first nipping position, the feeding roller pair being configured to further feed the medium toward the downstream side, in which when the nipping position of the feeding roller pair between which the medium is to be nipped is a second nipping position, the regulation section may be located above a tangent line at the second nipping position when viewed in the intersecting direction.

With this structure, the medium feeding apparatus further includes a feeding roller pair disposed downstream of the first nipping position, the feeding roller pair being configured to further feed the medium toward the downstream side, in which when the nipping position of the feeding roller pair between which the medium is to be nipped is a second nipping position, the regulation section does not protrude from a tangent line at the second nipping position when viewed in the medium width direction that intersects the medium feeding direction. Accordingly, the occurrence of damage such as scratches due to the regulation section to a medium to be fed can be reduced.

In the medium feeding apparatus, the regulation section may protrude from a straight line connecting the first nipping position and the second nipping position toward the feeding roller side when viewed in the intersecting direction. With this structure, the regulation section protrudes from a straight line connecting the first nipping position and the second nipping position toward the feeding roller side when viewed in the medium width direction that intersects the medium feeding direction. Accordingly, the contact of a medium with the separation roller can be more reliably reduced.

In the medium feeding apparatus, at least two separation rollers may be disposed in the intersecting direction, and the regulation section may be disposed between the two separation rollers.

With this structure, since at least two separation rollers is disposed in the intersecting direction and the regulation section is disposed between the two separation rollers, at least two separation rollers can commonly use the regulation section, and the cost increase of the apparatus can be reduced.

In the medium feeding apparatus, at least two separation rollers may be disposed in the intersecting direction, and the regulation sections may be disposed on both sides of the two separation rollers.

With this structure, since at least two separation rollers are disposed in the intersecting direction and the regulation sections are disposed on both sides of the two separation rollers, the contact of a medium with the separation roller can be more reliably reduced.

In the medium feeding apparatus, the regulation section may comprise a fixed member that is not moved by the contact with a medium. With this structure, when the regulation section comprises a fixed member that is not moved by the contact with a medium, the above-described functional effects can be achieved.

In the medium feeding apparatus, a corner portion of the fixed member in the intersecting direction may be rounded or chamfered. With this structure, since a corner portion of the fixed member in the intersecting direction is rounded or chamfered, the occurrence of damage such as scratches due to a corner portion of the fixed member to a medium to be fed can be reduced.

The medium feeding apparatus may further include a supporting member that supports the separation roller and forms a medium feeding path, in which the fixed member may be provided in the supporting member.

With this structure, the medium feeding apparatus further includes a supporting member that supports the separation roller and forms a medium feeding path, and the fixed member is provided in the supporting member. Accordingly, it is not necessary to additionally provide a dedicated mechanism for installing the fixed member and additional cost can be prevented.

In the medium feeding apparatus, the fixed member may be integrally provided with the supporting member. With this structure, since the fixed member is integrally provided with the supporting member, the cost can be further reduced.

In the medium feeding apparatus, the regulation section may comprise a roller configured to come into contact with the medium and rotate. With this structure, since the regulation section comprises a roller configured to come into contact with the medium and rotate, damage to a medium due to the friction between the regulation section and the medium can be reduced.

In the medium feeding apparatus, a plurality of fixed members may be disposed in the intersecting direction. With this structure, since a plurality of fixed members are disposed in the medium width direction that intersects the medium feeding direction, the contact of a medium with the separation roller can be more reliably reduced.

In the medium feeding apparatus, the regulation section may be configured to be moved toward or away from the medium feeding path and moved toward or away from the medium feeding path depending on the medium type.

With this structure, the regulation section is configured to be moved toward or away from the medium feeding path and moved toward or away from the medium feeding path depending on the medium type. Accordingly, for example, when a medium that has high stiffness and is not easily bent is fed, the regulation section is moved away from the medium feeding path, and thereby the stiff and less flexible medium can be appropriately fed.

According to another aspect of the invention, an image reading apparatus includes a reading section configured to read a medium and any one of the above-described medium feeding apparatuses configured to transport the medium to the reading section. According to this aspect, in the image reading apparatus, some of the above-described functional effects can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
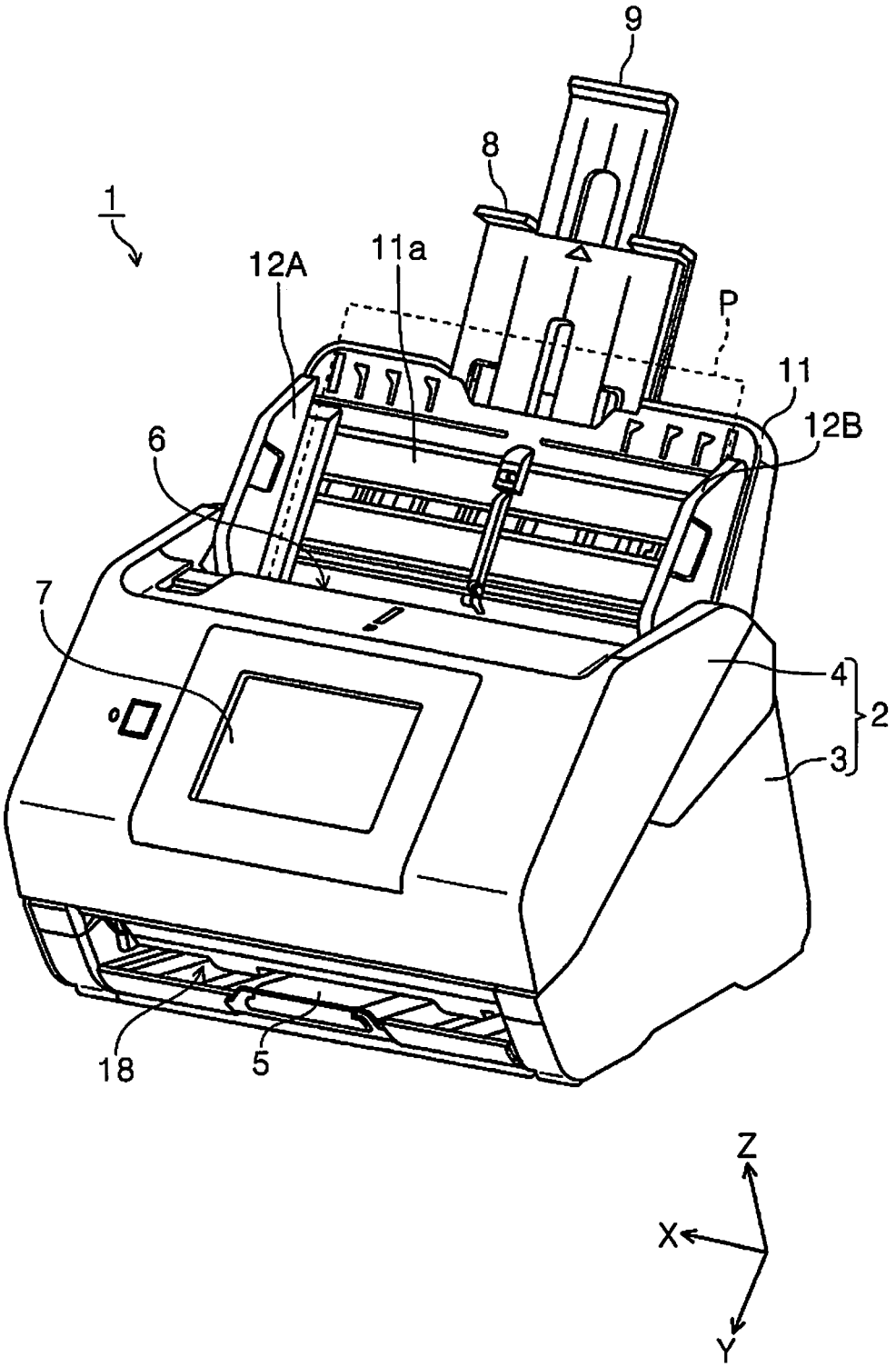
FIG. 1 is an external perspective view of a scanner according to an embodiment of the invention.

Hereinafter, a medium feeding apparatus and an image reading apparatus according to an embodiment of the invention will be described with reference to the drawings. In this embodiment, as an example image reading apparatus, a document scanner (hereinafter, simply referred to as a scanner 1) that can read an image on at least one of the front surface and the back surface of a document (hereinafter, referred to as a document P), which is an example medium, will be described.

In an X-Y-Z coordinate system in the drawings, an X direction denotes an apparatus width direction and a document width direction that intersects a document feeding direction (transport direction). A Y direction denotes the document feeding direction (transport direction). A Z direction intersects the Y direction and is approximately orthogonal to a surface of a document to be transported. A +Y direction side denotes an apparatus front side, and a −Y direction side denotes an apparatus back side. A left side viewed from the apparatus front side denotes a +X direction and a right side denotes a −X direction. A +Z direction side denotes an apparatus upper side (including upper sections, upper surfaces, and the like), and a −Z direction side denotes an apparatus lower side (including lower sections, lower surfaces, and the like). It should be noted that as is clear from FIG. 1 and FIG. 2, the Z direction is not parallel to the vertical direction. A direction (+Y direction side) toward which a document P is fed denotes "downstream" and the opposite direction (−Y direction side) denotes "upstream".

Hereinafter, the scanner 1, which is an example image reading apparatus according to the embodiment of the invention, will be described mainly with reference to FIG. 1. FIG. 1 is an external perspective view of the scanner 1 according to the embodiment of the invention. The scanner 1 has an apparatus body 2 that includes in it a reading section 20 (FIG. 2) for reading an image on a document P. The apparatus body 2 includes a lower unit 3 and an upper unit 4. The upper unit 4 is openably and closably attached to the lower unit 3 so as to be rotated about its downstream side in a document transport direction with respect to the lower unit 3. The upper unit 4 can be rotated and opened toward the apparatus front side so as to expose a document transport path of a document P for a user to readily fix a jam of the document P.

A document mounting section 11 on which a document P to be fed can be mounted is provided on the apparatus back side of the apparatus body 2. The document mounting section 11 can be detachably attached to the apparatus body 2. The document mounting section 11 is provided with a pair of edge guides (a first edge guide 12A and a second edge guide 12B) for guiding side edges of a document P in the width direction (X-axis direction) that intersects the feeding direction (Y-axis direction) of the document P.

The document mounting section 11 is provided with a first paper support 8 and a second paper support 9. The first paper support 8 and the second paper support 9 can be stored inside the document mounting section 11 and can be pulled out from the document mounting section 11 as illustrated in FIG. 1 such that the length of a mounting surface on which a document P is to be mounted can be adjusted.

The apparatus body 2 has an operation panel 7 on the apparatus front side of the upper unit 4. On the operation panel 7, a user interface (UI) for setting various settings for reading, for executing a reading operation, for displaying reading setting contents, or the like is implemented. The operation panel 7 is a touch panel through which both of a displaying operation and an inputting operation can be performed. The operation panel 7 serves as an operation section for various operations and a display section for displaying of various information. A feed port 6 that is connected to the inside of the apparatus body 2 is provided in an upper portion of the upper unit 4. A document P mounted on the document mounting section 11 is fed from the feed port 6 toward a reading section 20 provided in the apparatus body 2. A discharge tray 5 for receiving a discharged document P is provided on the apparatus front side of the lower unit 3.

Figure 2:
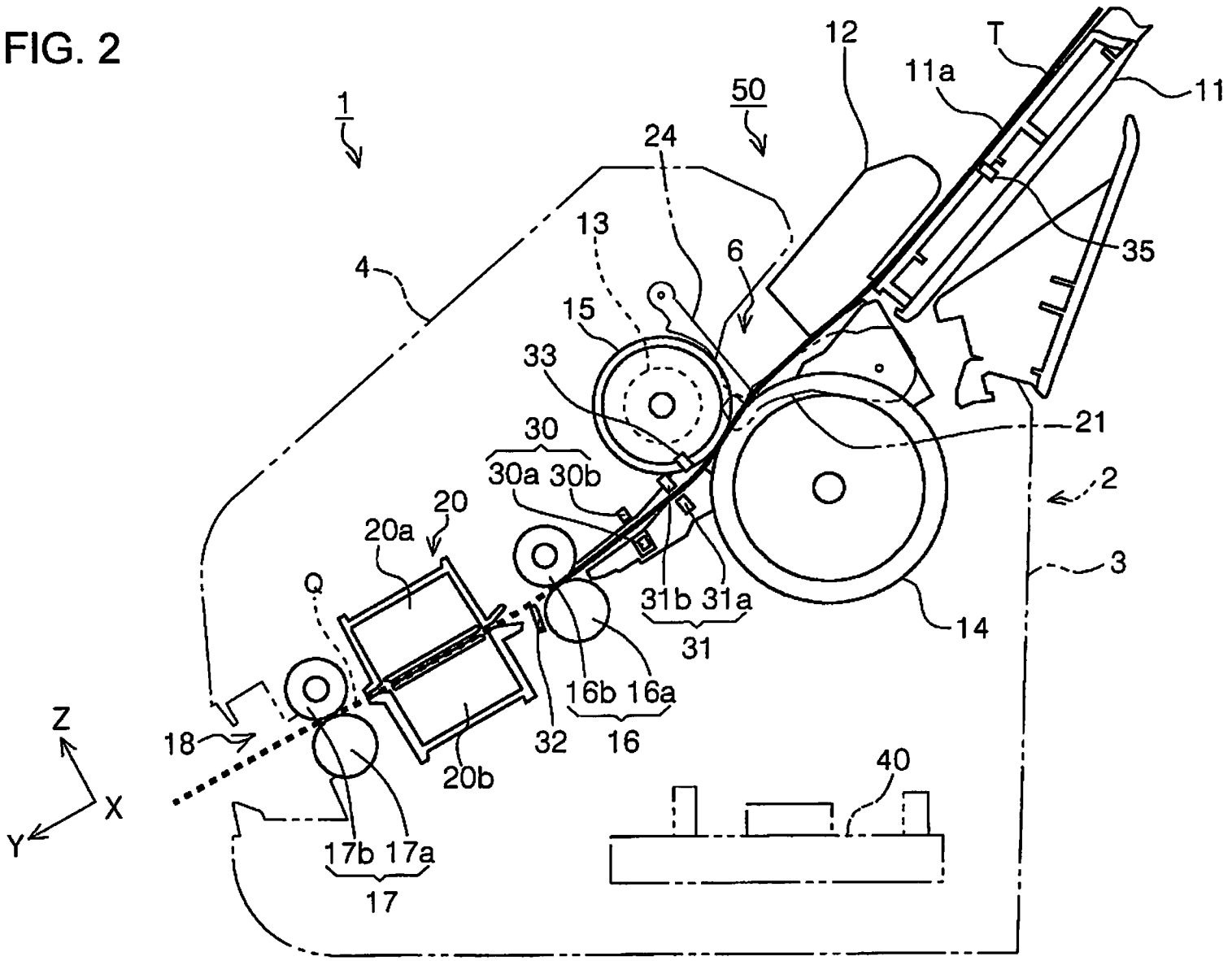
FIG. 2 is a side cross-sectional view of a document feeding path in a scanner according to an embodiment of the invention.

A document feeding apparatus 50 according to the embodiment of the invention, that is, a document feeding path in the scanner 1 will be described mainly with reference to FIG. 2 and with reference to other drawings as necessary. FIG. 2 is a side cross-sectional view of a document feeding path in the scanner 1 according to the embodiment. The scanner 1 includes the document feeding apparatus 50. The document feeding apparatus 50 typically includes components (the document mounting section 11, a feeding roller 14, a separation roller 15, and other components) relating to document feeding in the scanner 1. From another point of view, the document feeding apparatus 50 can serve as an apparatus that has the functions of the scanner 1 except a document reading function (a reading section 20, which will be described below). Alternatively, from another point of view in document feeding, the scanner 1 itself can be a document feeding apparatus even though the scanner 1 has the function (the reading section 20, which will be described below) relating to reading documents.

In FIG. 2, a solid line T indicates a document feeding path, that is, a trajectory of a document P. The document feeding path T is a space defined by the lower unit 3 and the upper unit 4. The document feeding path T can be defined as a path that extends from the document mounting section 11 to a transport roller pair 16. In FIG. 2, a path (document transport path) of a document downstream from the transport roller pair 16 is indicated by a broken line. The path indicated by the broken line, that is, a path of a document downstream from the transport roller pair 16, is hereinafter referred to as a downstream path Q.

The document mounting section 11 is disposed on the most upstream side of the document feeding path T. On the downstream side of the document mounting section 11, the feeding roller 14, which feeds a document P mounted on the document mounting section 11 toward the reading section 20, and the separation roller 15, which nips the document P with the feeding roller 14 and separates the document P, are disposed.

The feeding roller 14 comes into contact with a lowermost document P of documents P mounted on the document mounting section 11. Accordingly, when a plurality of documents P are set on the document mounting section 11 in the scanner 1, the documents P are fed sequentially from the document P on the side of the document mounting section 11 toward the downstream side. To the document mounting section 11, a mount detection section 35, which serves as a mount detection unit, for detecting whether a document P is mounted on the document mounting section 11 is provided.

Until the start of feeding, a document P that is being mounted on the document mounting section 11 is regulated by a flap 24 such that a leading edge of the document P does not enter a feeding standby position, that is, between the feeding roller 14 and the separation roller 15. The flap 24 is provided to a pressing unit 23 (FIG. 4) so as to be able to swing. In a feeding standby state, an end of the flap 24 enters a contact regulating section 21 that is disposed to face the flap 24 and thereby the swing is regulated. As will be described below, after the start of feeding, the contact regulating section 21 moves down to enable the flap 24 to swing, and the flap 24 swings to a position to open the feeding path. The pressing unit 23 (FIG. 4) can move toward or away from the feeding roller 14. The pressing unit 23 is urged by an urging member (not illustrated) in the direction the pressing unit 23 moves toward the feeding roller 14. The forward movement of the pressing unit 23 presses a document P that is being mounted on the document mounting section 11 toward the feeding roller 14.

The contact regulating section 21 is disposed on a side of the feeding roller 14 in the sheet width direction. The contact regulating section 21 can be switched by a motor (not illustrated) between a regulation state for regulating the forward movement of the pressing unit 23 toward the feeding roller 14 and a release state for allowing the forward movement of the pressing unit 23 toward the feeding roller 14. Until feeding is started, a stack of documents mounted on the document mounting section 11 is supported from below by the contact regulating section 21 that is in the regulation state such that the documents are separated from the feeding roller 14 so as not to come into contact with the feeding roller 14. After the start of feeding, the contact regulating section 21 moves downward such that the lowermost document P of the stack of documents comes into contact with the feeding roller 14 and the flap 24 becomes to be able to swing (the orientation can be switched). By the rotation of the feeding roller 14, the lowermost document P is fed downstream and the document P being fed downstream causes the flap 24 to swing to the downstream side to open the document feeding path.

Figure 4:
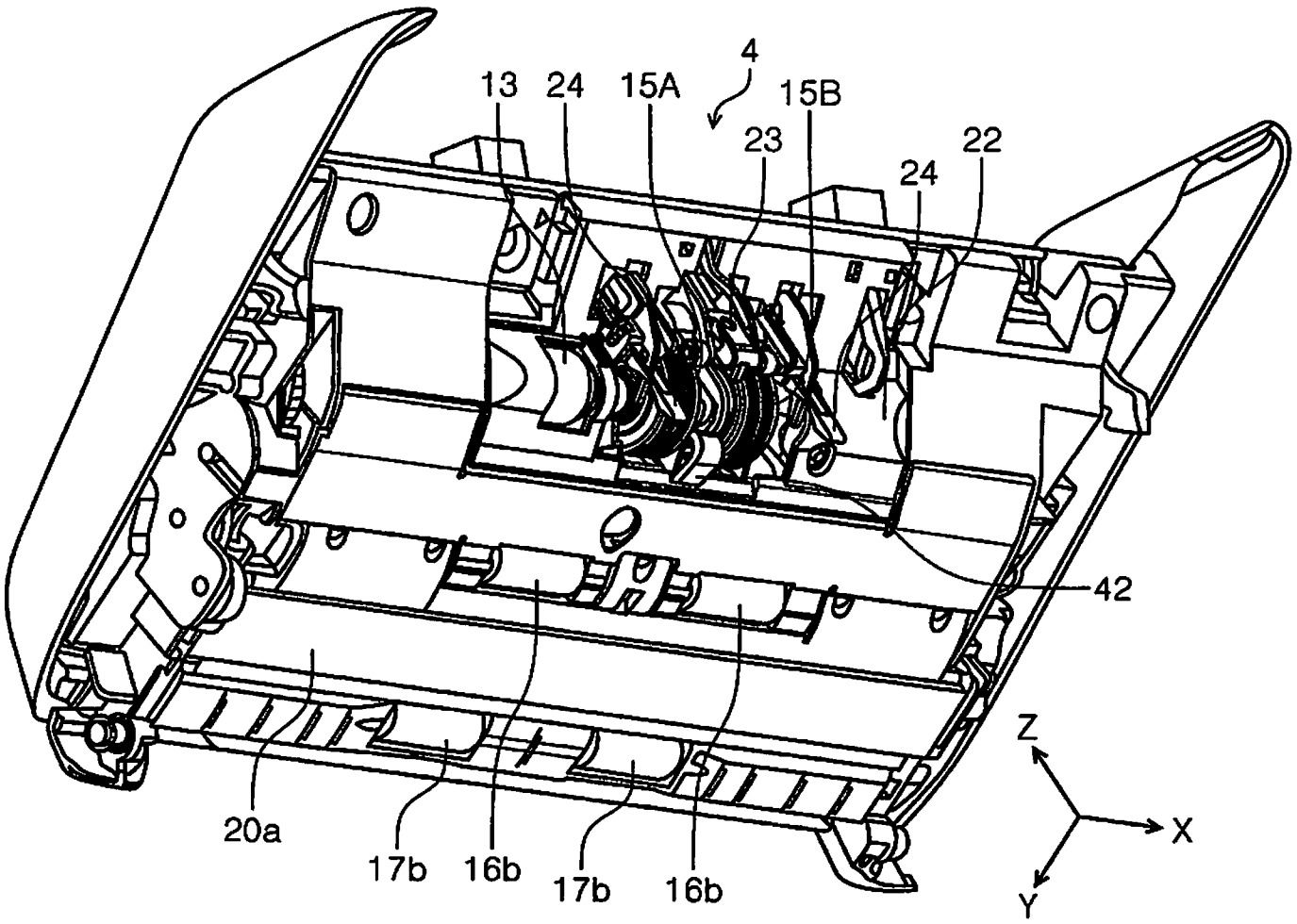
FIG. 4 is an overall perspective view illustrating a back side of an upper unit.

Two separation rollers 15 are disposed to be symmetric with respect to a central position in the document width direction. The separation rollers 15 are illustrated in FIG. 4. In FIG. 4, a separation roller 15A is disposed on one side with respect to the central position in the document width direction and a separation roller 15B is disposed on the other side. If it is not necessary to distinguish the separation rollers 15A and 15B, the separation rollers 15A and 15B are referred to as the separation roller 15. Similarly, two feeding rollers 14 (not illustrated) that are provided as pairs with the separation rollers 15 respectively are disposed to be symmetric with respect to the central position in the document width direction.

With the rotation torque from a motor for feeding (not illustrated), the feeding roller 14 rotates in the counterclockwise direction in FIG. 2. To the separation roller 15, the rotation torque for rotating the separation roller 15 in the counterclockwise direction in FIG. 2 is transmitted from a motor for transport (not illustrated) via a torque limiter 13. It should be noted that the actual rotation direction of the separation roller 15 is changed depending on situations.

When no document P is provided or only one sheet of document P is provided between the feeding roller 14 and the separation roller 15, the separation roller 15 is rotated (in the clockwise direction in FIG. 2) to follow the feeding roller 14 due to the slippage in the torque limiter 13 irrespective of the rotation torque applied from the motor for transport (not illustrated). In addition to the document P to be fed, if a second document P and subsequent documents P enter between the feeding roller 14 and the separation roller 15, a slippage occurs between the documents, and thus the separation roller 15 rotates in the counterclockwise direction in FIG. 2 with the rotation torque from the motor for transport (not illustrated). This rotation prevents or reduces multi-sheet feeding of the documents P. However, without a regulation section that will be described below, a phenomenon that causes reduction in the separation performance occurs. This phenomenon will be described below.

A transport roller pair 16, the reading section 20 for reading images, and a discharging roller pair 17 are disposed downstream of the feeding roller 14. The transport roller pair 16 includes a transport driving roller 16*a* that is driven to rotate by a motor for transport (not illustrated) and a transport driven roller 16*b* that follows the transport driving roller 16*a* to rotate. In this embodiment, two separation rollers 16*b* are disposed to be symmetric with respect to the central position in the document width direction as illustrated in FIG. 4. Although not illustrated, the transport driving rollers 16*a* that are provided as pairs with the transport driven rollers 16*b* are similarly disposed. A document P nipped by the feeding roller 14 and the separation roller 15 and fed downstream is nipped by the transport roller pairs 16 and transported to the reading section 20 that is disposed downstream of the transport roller pairs 16.

As illustrated in FIG. 2, a sound detector 33 that detects a sound generated in the document feeding path T and the downstream path Q is disposed near the nipping position between the feeding roller 14 and the separation roller 15, more specifically, slightly downstream of the nipping position. The sound detector 33 is a microphone that converts a sound into an electrical signal and sends the signal to a controller 40 that serves as a control section. The controller 40 determines whether a detection value acquired by the sound detector 33 is greater than or equal to a threshold value. If the detection value is greater than or equal to the threshold value, the controller 40 determines that a jam of a document P has occurred in the document feeding path T or the downstream path Q, and performs a predetermined process (for example, sounds an alert).

On the downstream side of the sound detector 33, a first document detector 31 is disposed. The first document detector 31 is, for example, an optical sensor that includes a light emitting unit 31*a* and a light receiving unit 31*b* that face each other across the document feeding path T. The light receiving unit 31*b* sends an electrical signal that indicates the intensity of a detection light to the controller 40. A document P being transported interrupts the detection light emitted from the light emitting unit 31*a* and the electrical signal indicating the intensity of the detection light changes. By the signal change, the controller 40 can detect the passage of a leading edge or a trailing edge of the document P.

On the downstream side of the first document detector 31, a multi-sheet feed detector 30 that detects multi-sheet feeding of documents P is disposed. The multi-sheet feed detector 30 includes an ultrasonic transmitter 30*a* and an ultrasonic receiver 30*b* for receiving ultrasonic waves that face each other across the document feeding path T. The ultrasonic receiver 30*b* sends an electrical signal that indicates the intensity of the detected ultrasonic waves to the controller 40. When multi-sheet feeding of documents P occurs, the electrical signal indicating the intensity of the ultrasonic waves changes and the electric signal change enables the controller 40 to detect the multi-sheet feeding of the documents P.

On the downstream side of the multi-sheet feed detector 30, a second document detector 32 is disposed. The second document detector 32 is a contact sensor that has a lever. In response to passage of a leading edge or a trailing edge of a document P, the lever rotates and the electrical signal sent from the second document detector 32 to the control section 40 changes. By the signal change, the controller 40 can detect the passage of the leading edge or the trailing edge of the document P. The controller 40 can determine the location of the document P in the document feeding path T with the above-described first document detector 31 and the second document detector 32.

The reading section 20, which is disposed on the downstream side of the second document detector 32, includes an upper read sensor 20*a* that is provided on the side of the upper unit 4 and a lower read sensor 20*b* that is provided on the side of the lower unit 3. In this embodiment, as an example, the upper read sensor 20*a* and the lower read sensor 20*b* are configured as a contact image sensor (CIS) module.

After an image on at least one of the front side and the back side of a document P has been read in the reading section 20, the document P is nipped by the discharging roller pair 17 that is disposed downstream of the reading section 20 and discharged from a discharge port 18 that is provided on the apparatus front side of the lower unit 3. The discharging roller pair 17 includes a discharge driving roller 17*a* that is driven to rotate by a motor for transport (not illustrated) and a discharge driven roller 17*b* that follows the discharge driving roller 17*a* to rotate. Two discharge driven rollers 17*b* are disposed to be symmetric with respect to the central position in the document width direction as illustrated in FIG. 4 in this embodiment. The discharge driving rollers 17*a* are similarly disposed.

Figure 3A:
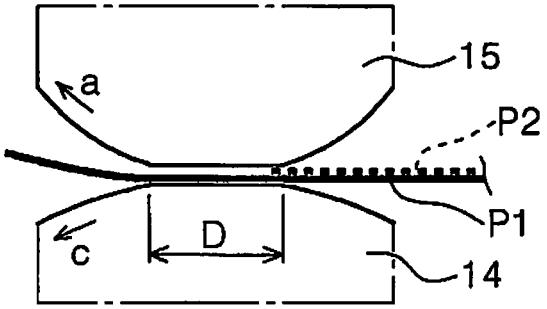
FIGS. 3A, 3B, and 3C are schematic views illustrating a mechanism of the occurrence of multi-sheet feeding.
Figure 3B:
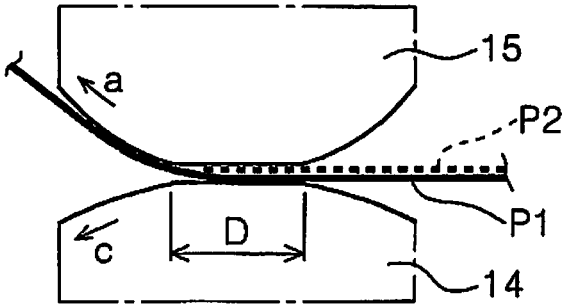
Figure 3C:
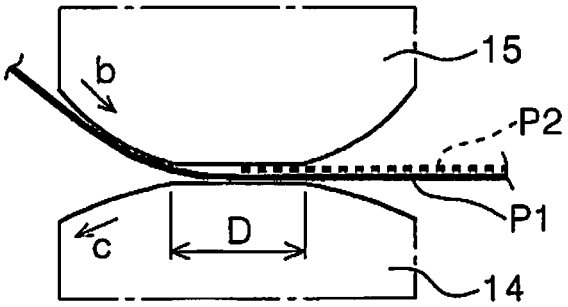

With reference to FIGS. 3A, 3B, and 3C, problems in separating a document P by the separation roller 15 in a structure without a regulation section, which is described below, will be described. In FIGS. 3A, 3B, and 3C, a solid line P1 denotes a lowermost document to be fed, and a broken line P2 denotes a document that is about to be multi-fed together with the lowermost document. An area D indicates an area where a document is nipped by the feeding roller 14 and the separation roller 15. Specifically, the feeding roller 14 and the separation roller 15 are made of an elastic material such as elastomer, and the separation roller 15 is urged against the feeding roller 14 by an urging member (not illustrated). Accordingly, the rollers are deformed to some extent in the nipping position and the nipping area has a certain length. Although the direction to which a document is actually fed by the feeding roller 14 and the separation roller 15 is an obliquely downward direction as illustrated in FIG. 2, for the sake of convenience, the document feeding direction is illustrated as a horizontal direction in FIGS. 3A, 3B, and 3C. FIGS. 3A, 3B, and 3C illustrate different feeding states respectively. The state in FIG. 3B is a state after the state in FIG. 3A, and the state in FIG. 3C is a state after the state in FIG. 3B.

In the state in FIG. 3A, a leading edge of a document P1 to be fed has not reached the transport roller pair 16 on the downstream side. In the nipping area D, since the document P1 mainly comes into contact with the separation roller 15, the separation roller 15 is subjected to the feeding force of the feeding roller 14 and is rotated in an arrow a direction together with the document P1 that proceeds toward the downstream side, that is, the separation roller 15 is rotated in a forward direction for feeding the document to the downstream side. An arrow c denotes a rotation direction of the feeding roller 14.

In the state in FIG. 3B, the document P1 to be fed is nipped by the transport roller pair 16 on the downstream side. In this state, the document feeding speed of the transport roller pair 16 is set to a speed higher than a document feeding speed of the feeding roller 14, and the transport roller pair 16 stretches the document P1 accordingly. Due to the shape of the document feeding path, the document P1 winds around the separation roller 15 on the downstream side of the nipping position of the separation roller 15 and the feeding roller 14. Since the separation roller 15 is rotating in the forward direction a, a document P2 that is about to be multi-fed further proceeds downstream and the contact length with the separation roller 15 increases. Typically, after the document P2 about to be multi-fed deeply enters between the separation roller 15 and the feeding roller 14, the separation roller 15 is subjected to very low rotation torque of the document P1 to be fed in the forward direction a and the separation roller 15 is subjected to the power of the motor for feeding (not illustrated) and rotates in the direction (document returning direction b) opposite to the forward feeding direction a.

However, as described above, when the lowermost document P1 to be fed winds around the separation roller 15 to some extent on the downstream side of the nipping position between the separation roller 15 and the feeding roller 14, the separation roller 15 that will be rotated in the document returning direction b is continuously rotated in the forward feeding direction a. As a result, the document P2 about to be fed is further fed to the downstream side than expected and can cause separation failure. In other words, the rotation of the separation roller 15 in the document returning direction b delays. Furthermore, the document P1 holds the separation roller 15 upward against an urging member (not illustrated) that urges the separation roller 15 toward the feeding roller 14, and an appropriate nipping force may not be provided, resulting in separation failure.

The state in FIG. 3C is a state in which the feeding process has further proceeded from the state in FIG. 3E. As the document P2 about to be multi-fed further proceeds downstream, the area in which the document P1 to be fed and the separation roller 15 come into contact with each other becomes narrower and the force of the document P1 to rotate the separation roller 15 decreases, causing the separation roller 15 to rotate in the document returning direction b. In this state, the document P2 is returned upstream; however, since the downstream side of the document P1 is being held by the transport roller pair 16, the document P1 is not returned upstream. Furthermore, since the document P1 is winding around the separation roller 15 to some extend on the downstream side of the nipping position between the separation roller 15 and the feeding roller 14, the separation roller 15 rotating in the document returning direction b causes friction between the document P1 and the separation roller 15, which may produce an abnormal sound or may damage the surface of the document P1. After the state in FIG. 3C, the state returns to the state in FIG. 3A, and the above-described phenomena repeatedly occurs.

To solve the problems, the document feeding apparatus 50 according to the embodiment is provided with a regulation section 42 on the downstream side of the nipping position between the feeding roller 14 and the separation roller 15. The regulation section 42 is configured to come into contact with a document P1 from the side of the separation roller 15 to regulate the contact between the document P1 to be fed and the separation roller 15 as illustrated in FIGS. 4, 5, 6, and 7. With the regulation section 42, the amount of winding (contact amount) of a document P1 around the separation roller 15 on the downstream side of the nipping position between the separation roller 15 and the feeding roller 14 can be reduced and the winding (contact) can be reduced or prevented. Accordingly, the rotation of the separation roller 15 in the forward feeding direction a due to a document P1 to be fed can be regulated, that is, the reduction in the separation performance can be reduced.

Figure 5:
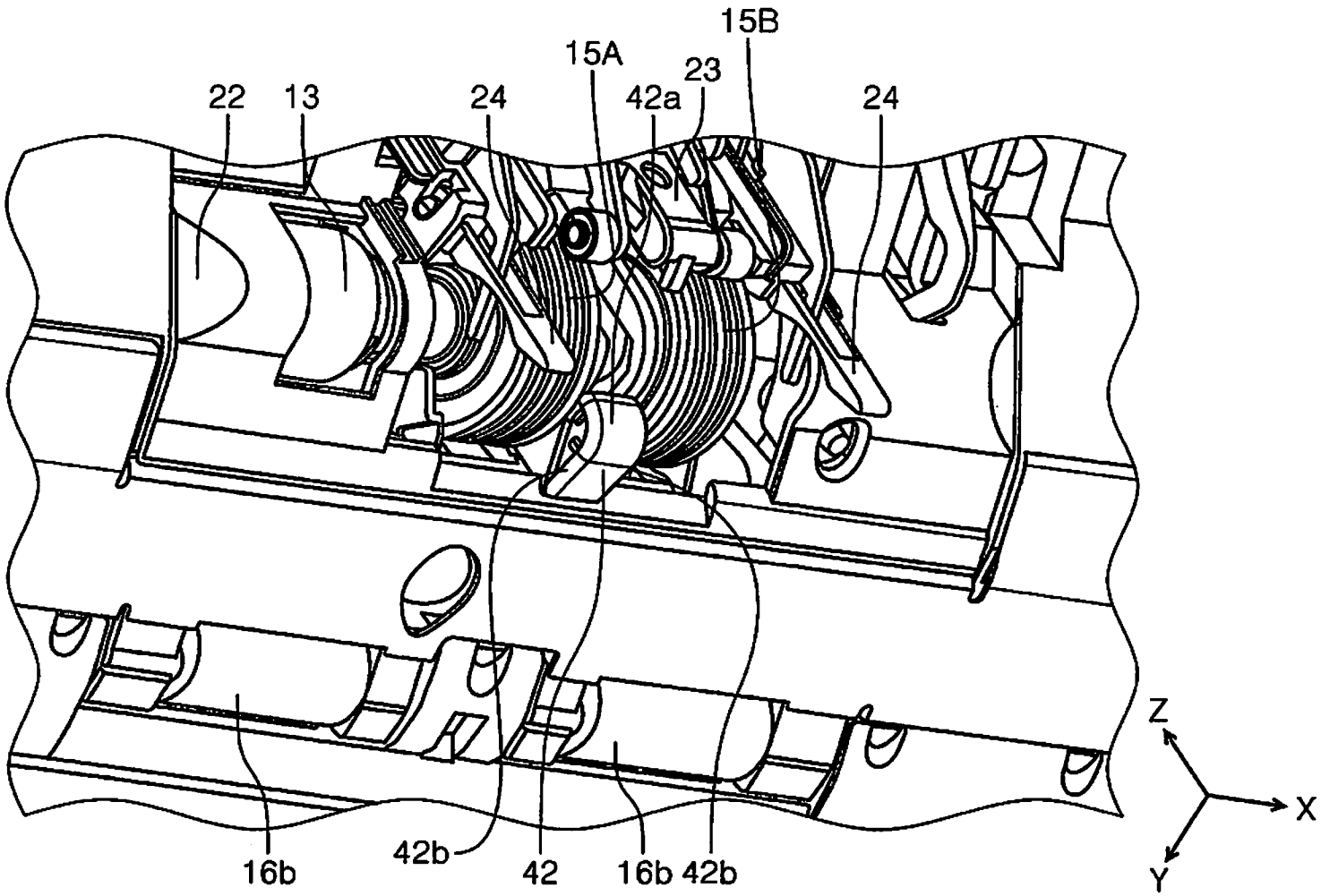
FIG. 5 is a partial enlarged perspective view of a back side of an upper unit.
Figure 6:
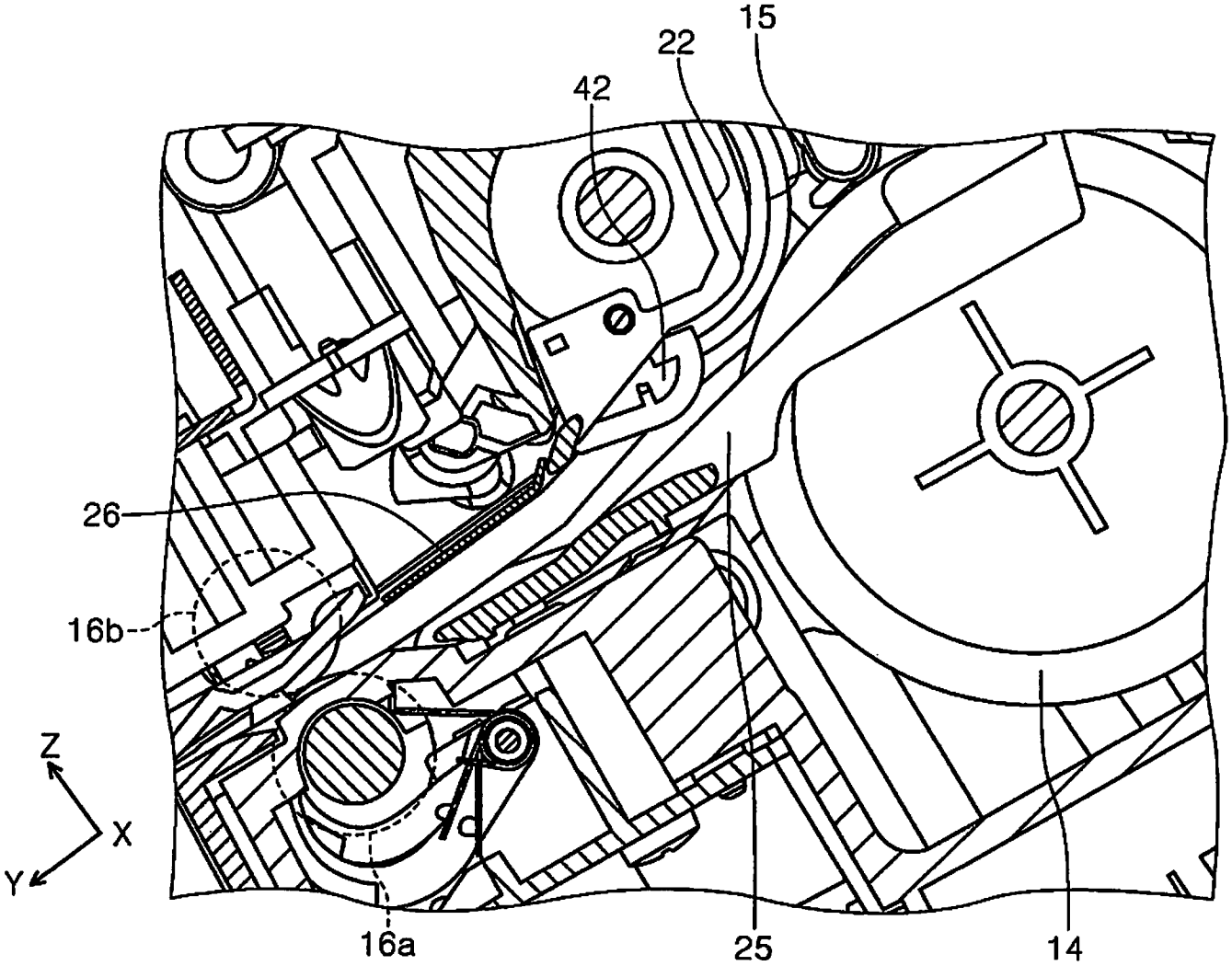
FIG. 6 is a side view of a sheet feeding path around a separation roller and a feeding roller.

Hereinafter, the regulation section 42 will be further described. FIGS. 4 to 6 illustrate a path forming member 22 that serves as a "supporting member" for supporting the separation roller 15. The path forming member 22 supports the separation roller 15 and forms a document feeding path. The path forming member 22 can swing about a fulcrum (not illustrated) with respect to the upper unit 4. A user can move the path forming member 22 to swing open to replace the separation roller 15. The regulation section 42 is provided in the path forming member 22. Accordingly, it is not necessary to provide a dedicated mechanism for installing the regulation section 42 and additional cost can be prevented.

In this embodiment, the regulation section 42 and the path forming member 22 are separated parts; however, the regulation section 42 may be integrally provided with the path forming member 22. With this structure, the cost can be further reduced.

The regulation section 42 according to the embodiment is a fixed member that is not moved by the contact with a document. As illustrated in FIG. 5, corner portions 42*b* on both sides of the regulation section 42 in the document width direction are rounded. The rounded corner portions of the regulation section 42 can reduce the occurrence of damage such as scratches to documents. The shape of the corner portions 42*b* is not limited to the rounded shape. Alternatively, the corner portions 42*b* may be chamfered. A corner portion 42*a* of the regulation section 42 on the upstream side in the document feeding direction is also rounded, and this shape of the corner portion 42*a* can reduce the occurrence of damage such as scratches to documents.

The regulation section 42 according to the embodiment is disposed between the two separation rollers 15 as illustrated in FIG. 4 and FIG. 5. With this structure, at least two separation rollers 15 can commonly use the regulation section 42, and the cost increase of the apparatus can be reduced.

Figure 7:
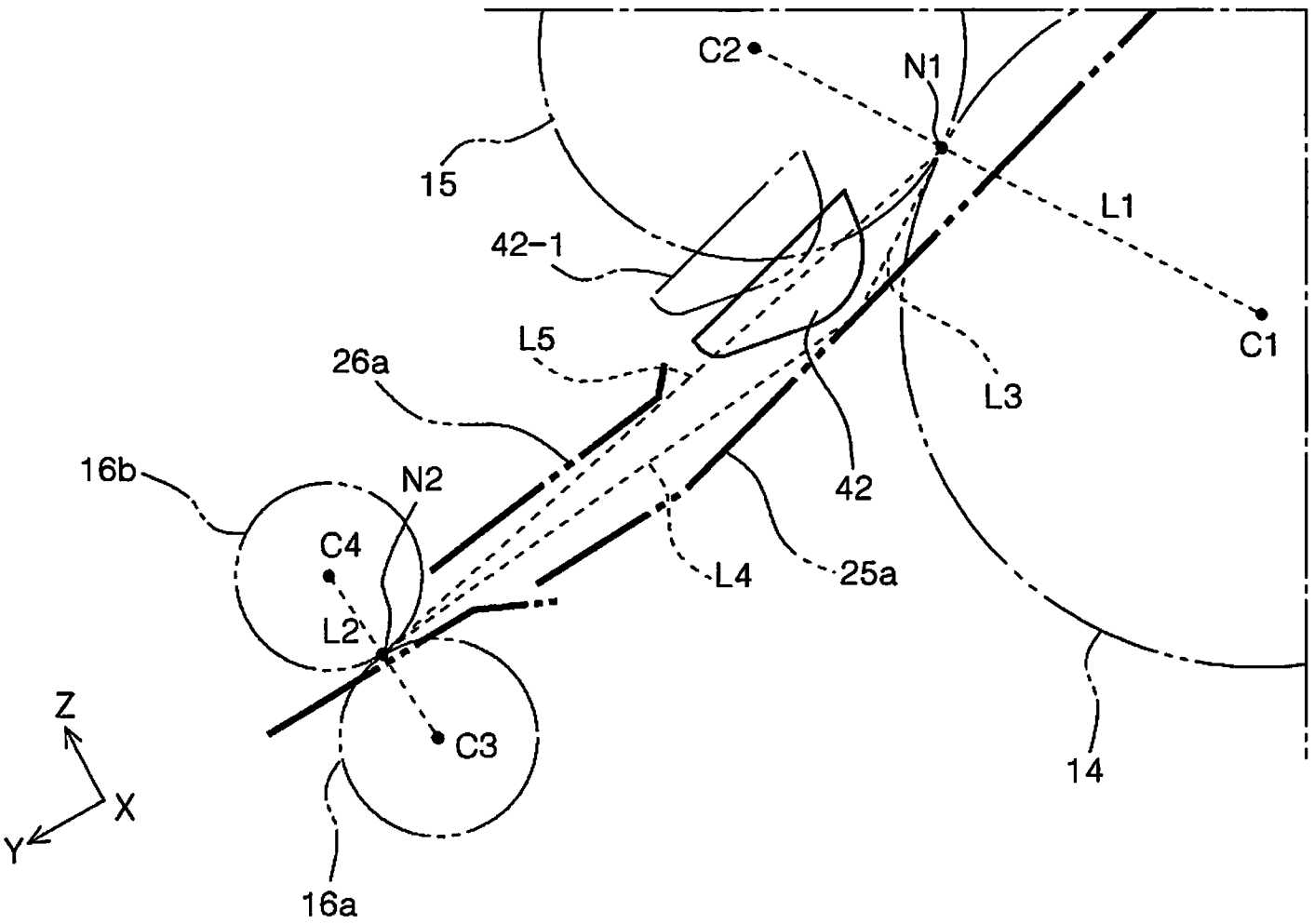
FIG. 7 is a simplified view of a sheet feeding path around a separation roller and a feeding roller.

Hereinafter, the regulation section 42 will be described further in detail with reference to FIG. 7. First, each of reference numerals in FIG. 7 will be described. FIG. 7 illustrates a positional relationship among the components viewed in the document width direction. A reference numeral C1 denotes a rotation central position of the feeding roller 14. A reference numeral C2 denotes a rotation central position of the separation roller 15. A reference numeral C3 denotes a rotation central position of the transport driving roller 16*a*. A reference numeral C4 denotes a rotation central position of the transport driven roller 16*b*. A reference numeral N1 denotes a nipping position (a contact position of the rollers 14 and 15 on the premise that both rollers are not deformed) between the feeding roller 14 and the separation roller 15. A reference numeral N2 denotes a nipping position (a contact position of the rollers 16*a* and 16*b* on the premise that both rollers are not deformed) between the transport driving roller 16*a* and the transport driven roller 16*b*.

A reference numeral L1 denotes a straight line that connects the rotation central position C1 and the rotation central position C2. A reference numeral L2 denotes a straight line that connects the rotation central position C3 and the rotation central position C4. A reference numeral L3 denotes a tangent line at the nipping position N1. A reference numeral L4 denotes a tangent line at the nipping position N2. A reference numeral L5 denotes a straight line that connects the nipping position N1 and the nipping position N2.

A reference numeral 25*a* denotes a surface of a path that is formed by a path forming member 25 (FIG. 6). A reference numeral 26*a* is a surface of a path that is formed by a path forming member 26 (FIG. 6). In this embodiment, the angle formed by the straight line L1 and the straight line L2 is an acute angle, and although not illustrated, an angular relationship in which the straight line L1 and the straight line L2 intersect in the upward direction in FIG. 7 is formed. In this relationship, a document P that is fed from between the feeding roller 14 and the separation roller 15 comes into contact with the path surface 25*a*. The straight line L5 is in a positional relationship in which the straight line L5 intersects the outer periphery of the separation roller 15.

It is apparent from FIG. 7 that at least a part of the regulation section 42 is within the region of the separation roller 15 when viewed in the document width direction. Accordingly, at a position near the nipping position N1, the winding of a document P around the separation roller 15 can be regulated and the winding of the document P around the separation roller 15 can be further reliably regulated.

The regulation section 42 does not protrude from the tangent line L3 at the nipping position N1, which is a first nipping position, toward the feeding roller 14 side. With this structure, the occurrence of damage such as scratches due to the regulation section 42 to a document P to be fed can be reduced.

Furthermore, the regulation section 42 does not protrude from the tangent line L4 at the nipping position N2, which is a second nipping position, toward the feeding roller 14 side. With this structure, the occurrence of damage such as scratches due to the regulation section 42 to a document P to be fed can be reduced.

The regulation section 42 protrudes from the straight line L5, which connects the nipping position N1 and the nipping position N2, toward the feeding roller 14 side. Accordingly, the winding of a document P around the separation roller 15 can be more reliably regulated.

Figure 8:
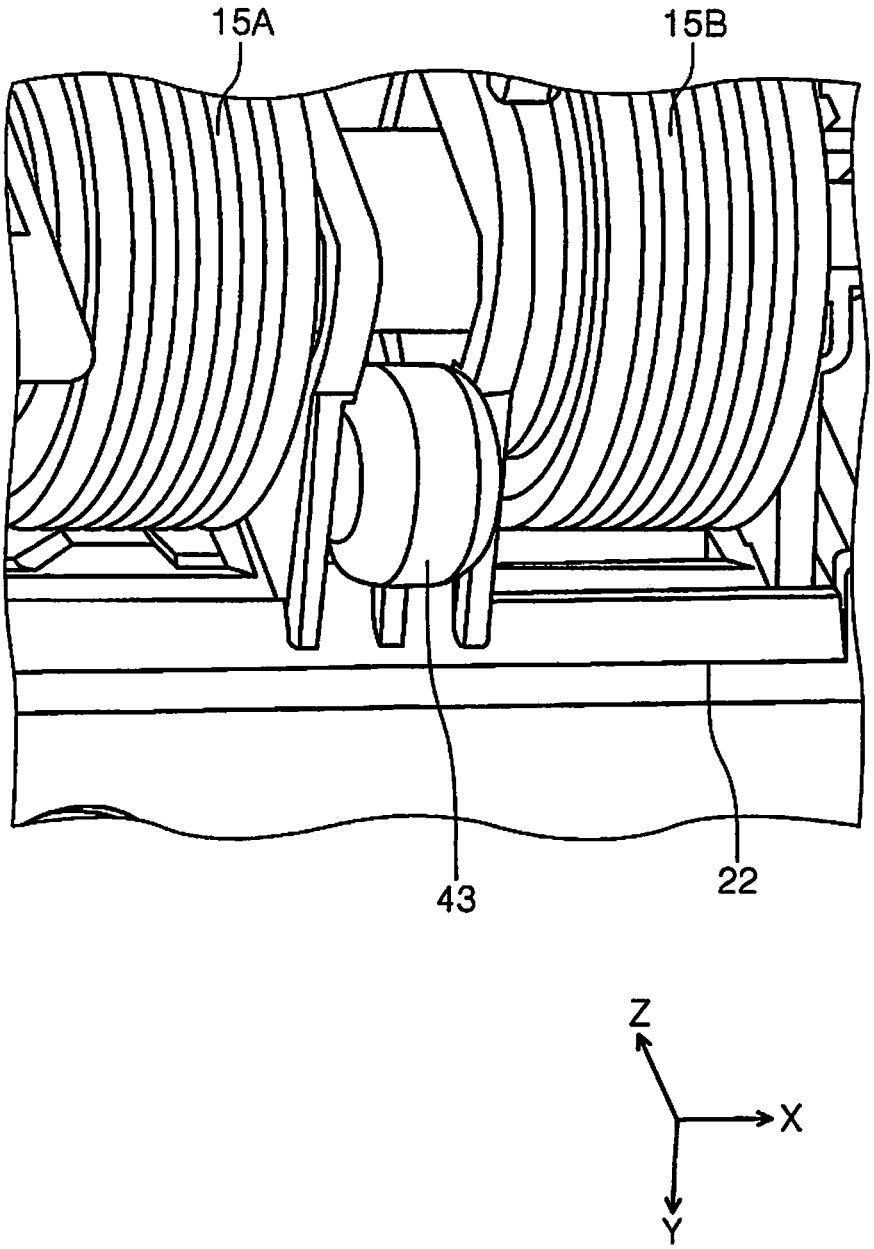
FIG. 8 is a perspective view illustrating a regulation section according to another embodiment.

The above-described embodiment is a mere example, and for example, the regulation section may be modified in various ways as described below. A regulation section 43 illustrated in FIG. 8 comprises a roller that comes into contact with a document P and rotates. With this structure, damage to a document P due to the friction between the regulation section 43 and the document P can be reduced.

Figure 9:
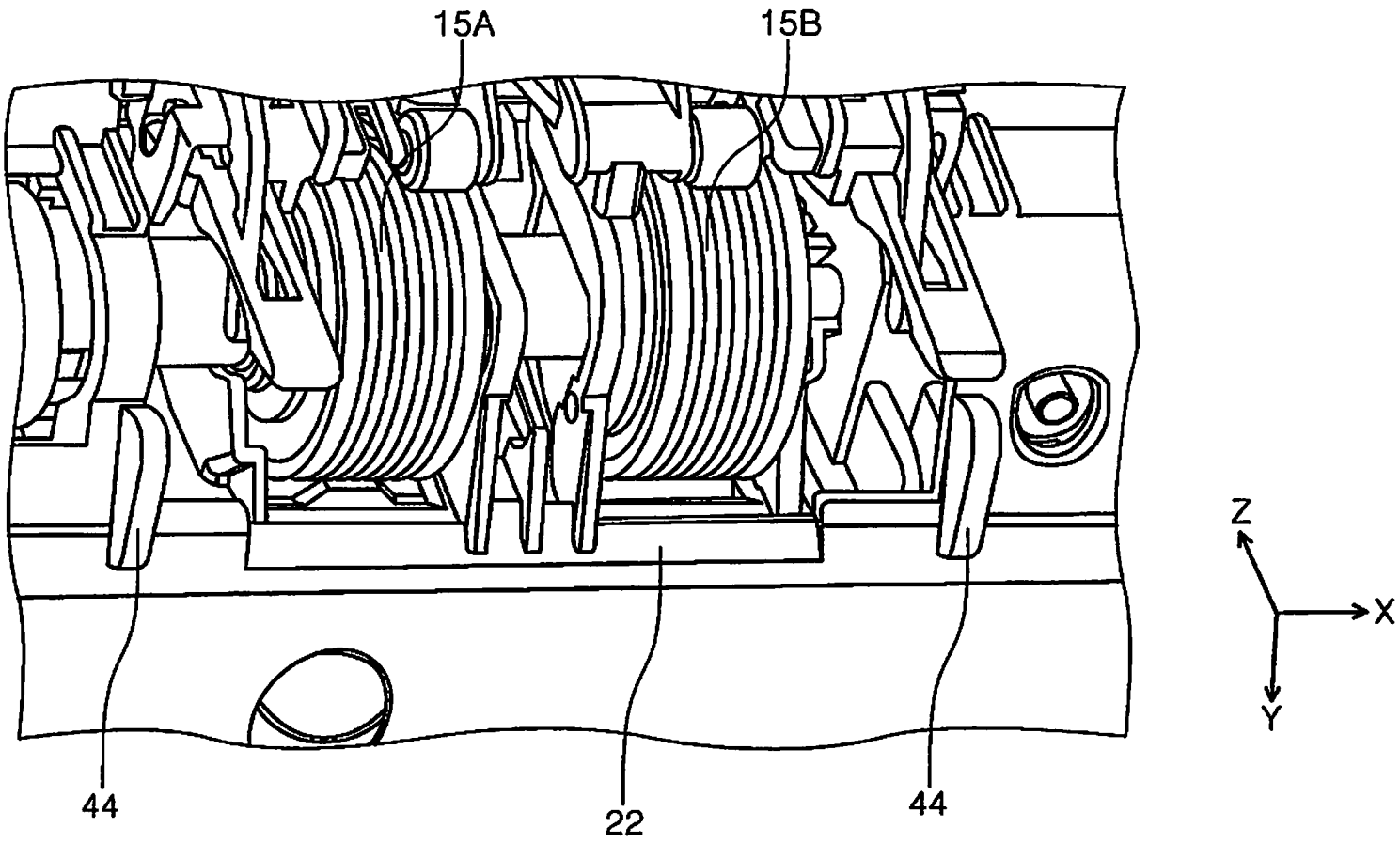
FIG. 9 is a perspective view illustrating a regulation section according to still another embodiment.
Figure 10:
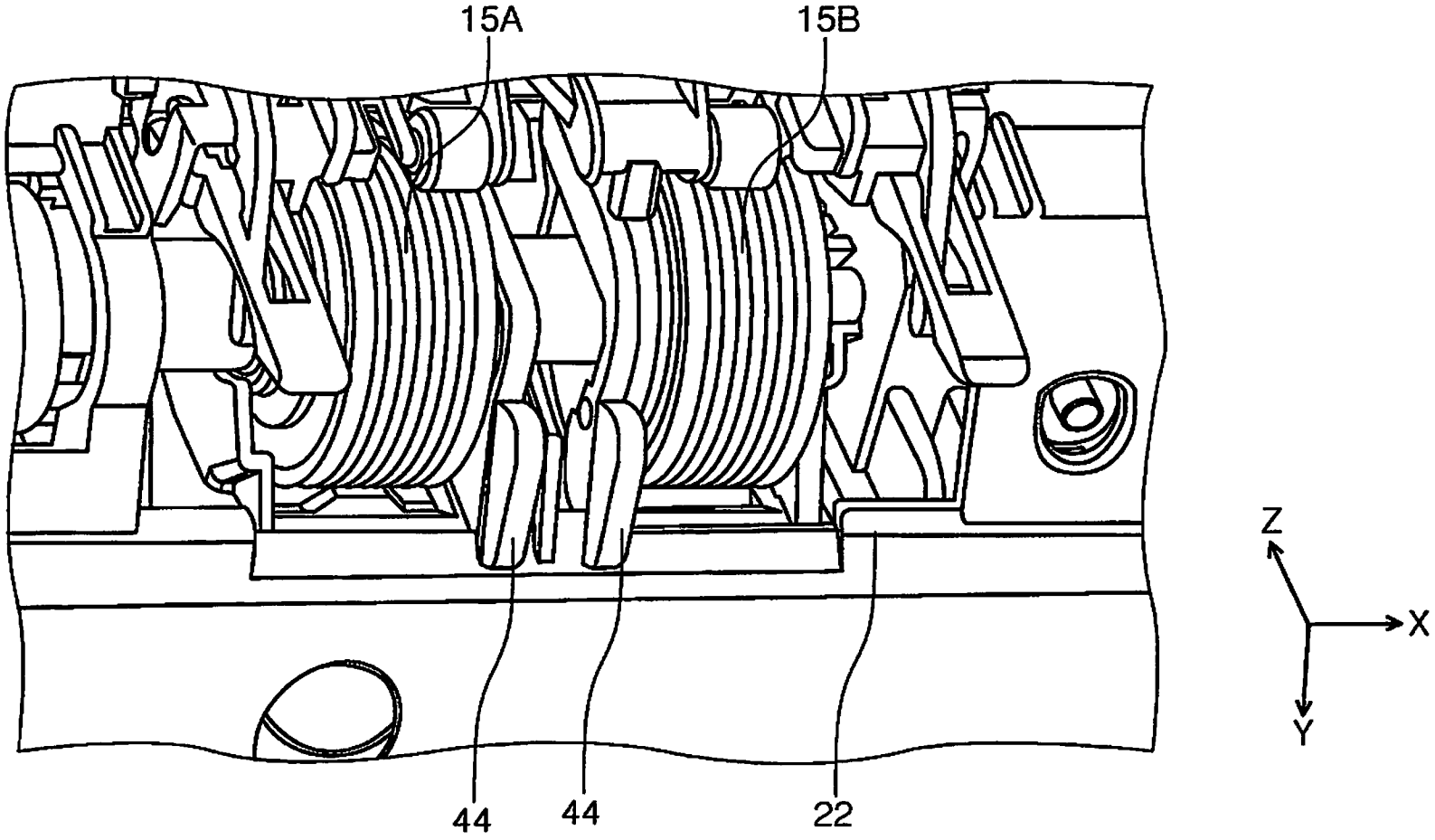
FIG. 10 is a perspective view illustrating a regulation section according to yet another embodiment.

Regulation sections 44 illustrated in FIG. 9 are disposed on both sides of the two separation rollers 15A and 15B. Accordingly, the winding of a document P around the separation roller 15 can be more reliably regulated.

In the structure in FIG. 9, the plurality of regulation sections 44 that serve as fixed members are disposed in the document width direction. Accordingly, the winding of a document P around the separation roller 15 can be more reliably regulated.

The regulation sections 42, 43, and 44 in the above-described embodiments may be moved toward or away from the document feeding path. For example, in the case of the regulation section 42, a position indicated by a line (chain double-dashed line) 42-1 in FIG. 7 may be defined as a reverse position and a position indicated by a line (solid line) 42 may be defined as a forward position, and the regulation section 42 may be moved in the forward direction or in the reverse direction. Such a forward and reverse movement may be implemented, for example, by using a cam mechanism that is powered by a motor or the like or by using a solenoid. The controller 40 (FIG. 2) can cause the regulation section 42 to move in the forward direction or in the reverse direction depending on the type of document P.

Figure 11:
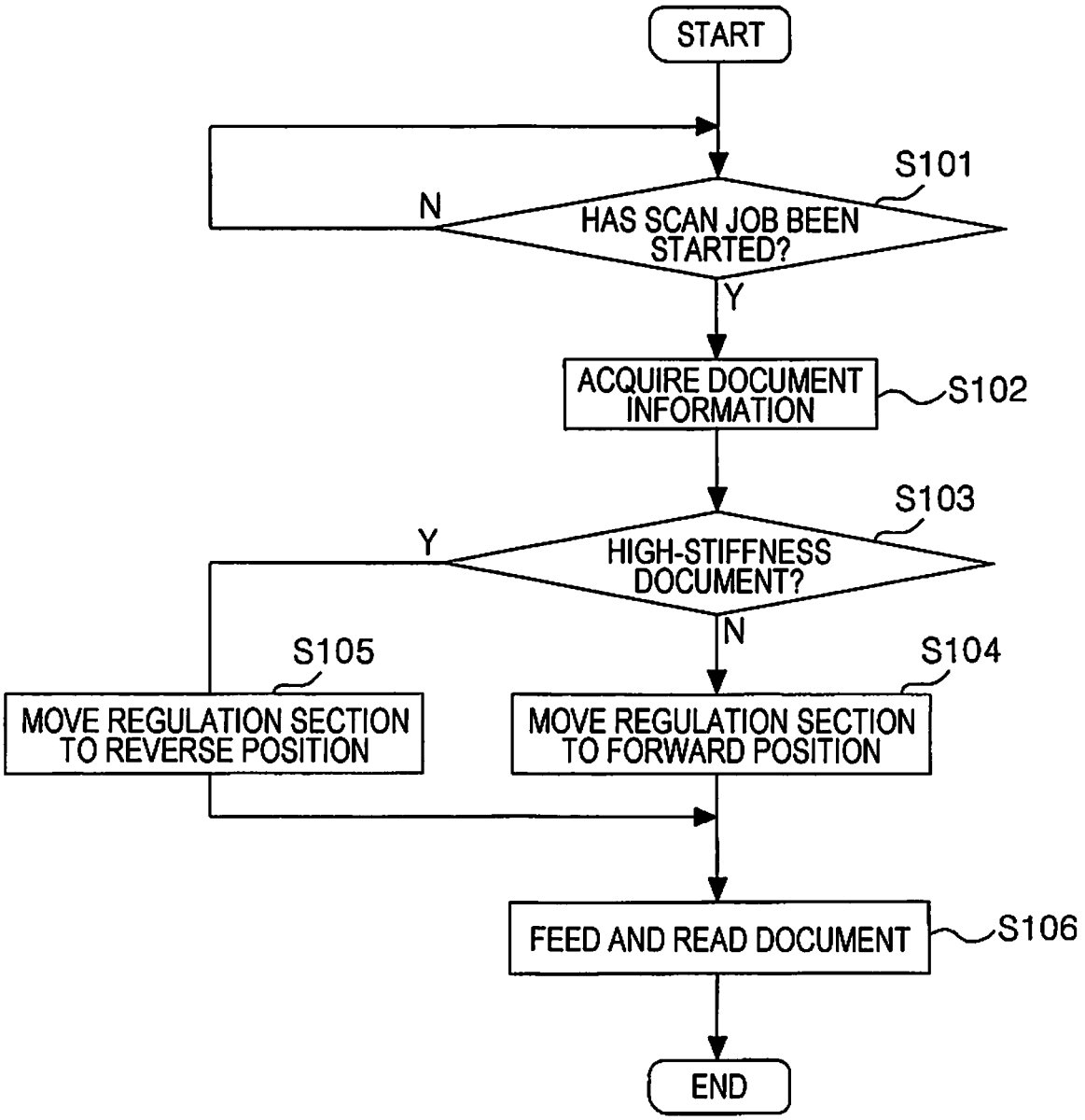
FIG. 11 is a flowchart illustrating a process of controlling switching of a regulation section.

For example, when a document P that has high stiffness and is not easily bent is fed, the regulation section 42 is moved away from the document feeding path, and thereby the stiff and less flexible document P can be appropriately fed. Examples of the stiff and less flexible document include a document (for example, a plastic card) of a card size defined by ISO/IEC 7810 ID-1. FIG. 11 illustrates a control process to be performed by the controller 40 (FIG. 2). In response to an instruction for starting a scan job (Y in step S101), the controller 40 acquires information about the document type (step S102).

In this step, the controller 40 can acquire the document type, for example, based on the document type that has been set via the operation panel 7. Alternatively, when a detecting unit for detecting positions of the pair of the edge guides 12A and 12B (FIG. 1) is provided, if the pair of the edge guides 12A and 12B are at positions for guiding a document of the above-described card size, the controller 40 can recognize that the document type is the card.

When the controller 40 determines that the document is a high-stiffness document (Y in step S103), the regulation section 42 is switched to the reverse position (step S105). When the controller 40 determines that the document is not a high-stiffness document (N in step S103), the regulation section 42 is switched to the forward position (step S104). Then, the document is fed and read (step S106). When the forward position of the regulation section 42 is a default position, no control is performed in step S104.

In the above description, the scanner, which is an example image reading apparatus, has been described as the embodiments of the medium feeding apparatus of the invention. Alternatively, embodiments of the invention may be applied to recording apparatuses that have a recording head for performing recording onto a medium, such as printers. In such a case, in the structure in FIG. 2, the upper read sensor 20*a* may be replaced with a recording head and the lower read sensor 20*b* may be replaced with a supporting member for supporting paper.

The entire disclosure of Japanese Patent Application No. 2018-058212, filed Mar. 26, 2018 is expressly incorporated by reference herein.

What is claimed is:

1. A medium feeding apparatus comprising:

a mounting section on which a medium to be fed is mounted;

a feeding roller configured to feed the medium mounted on the mounting section;

a separation roller configured to nip and separate the medium with the feeding roller therebetween;

a regulation section disposed downstream of the nipping position between the feeding roller and the separation roller, the regulation section being disposed at a position different from the separation roller in an intersecting direction that intersects a medium feeding direction, and the regulation section being configured to regulate the contact of the medium to be fed and the separation roller; and a feeding roller pair, wherein when the nipping position between the feeding roller and the separation roller is a first nipping position, the regulation section is located entirely spaced apart from a tangent line at the first nipping position when viewed in the intersecting direction such that the tangent line does not intersect the regulation section when viewed in the intersecting direction, wherein when the nipping position between the feeding roller and the separation roller is the first nipping position, the regulation section is located above the tangent line at the first nipping position when viewed in the intersecting direction, wherein the feeding roller pair is disposed downstream of the first nipping position, the feeding roller pair being configured to further feed the medium toward the downstream side, wherein when the nipping position of the feeding roller pair between which the medium is to be nipped is a second nipping position, the regulation section is located above a tangent line at the second nipping position when viewed in the intersecting direction.

2. The medium feeding apparatus according to claim 1, wherein the regulation section is disposed, with respect to the medium to be fed, so as to come into contact with the medium from the side of the separation roller.

3. The medium feeding apparatus according to claim 1, wherein a part of the regulation section is within an area of the separation roller when viewed in the intersecting direction.

4. The medium feeding apparatus according to claim 1, wherein the regulation section protrudes from a straight line connecting the first nipping position and the second nipping position toward the feeding roller side when viewed in the intersecting direction.

5. The medium feeding apparatus according to claim 1, wherein the regulation section comprises a fixed member that is not moved by the contact with a medium.

6. The medium feeding apparatus according to claim 5, wherein a corner portion of the fixed member in the intersecting direction is rounded or chamfered.

7. The medium feeding apparatus according to claim 1, wherein the regulation section comprises a roller configured to come into contact with the medium and rotate.

8. The medium feeding apparatus according to claim 1, wherein a plurality of regulation sections are disposed in the intersecting direction.

9. An image reading apparatus comprising:

a reading section configured to read a medium; and the medium feeding apparatus according to claim 1 configured to transport the medium to the reading section.

10. A medium feeding apparatus comprising:

a mounting section on which a medium to be fed is mounted;

a feeding roller configured to feed the medium mounted on the mounting section;

a separation roller configured to nip and separate the medium with the feeding roller therebetween; and a regulation section disposed downstream of the nipping position between the feeding roller and the separation roller, the regulation section being disposed at a position different from the separation roller in an intersecting direction that intersects a medium feeding direction, and the regulation section being configured to regulate the contact of the medium to be fed and the separation roller, wherein when the nipping position between the feeding roller and the separation roller is a first nipping position, the regulation section is located entirely spaced apart from a tangent line at the first nipping position when viewed in the intersecting direction such that the tangent line does not intersect the regulation section when viewed in the intersecting direction, wherein at least two separation rollers are disposed in the intersecting direction, and the regulation section is disposed between the two separation rollers.

11. An image reading apparatus comprising:

a reading section configured to read a medium; and the medium feeding apparatus according to claim 10 configured to transport the medium to the reading section.

12. The medium feeding apparatus comprising:

a mounting section on which a medium to be fed is mounted;

a feeding roller configured to feed the medium mounted on the mounting section;

a separation roller configured to nip and separate the medium with the feeding roller therebetween; and a regulation section disposed downstream of the nipping position between the feeding roller and the separation roller, the regulation section being disposed at a position different from the separation roller in an intersecting direction that intersects a medium feeding direction, and the regulation section being configured to regulate the contact of the medium to be fed and the separation roller, wherein when the nipping position between the feeding roller and the separation roller is a first nipping position, the regulation section is located entirely spaced apart from a tangent line at the first nipping position when viewed in the intersecting direction such that the tangent line does not intersect the regulation section when viewed in the intersecting direction, wherein at least two separation rollers and at least two regulation sections are disposed in the intersecting direction, and the at least two regulation sections are disposed on both sides of the at least two separation rollers.

13. An image reading apparatus comprising:

a reading section configured to read a medium; and the medium feeding apparatus according to claim 12 configured to transport the medium to the reading section.

14. A medium feeding apparatus comprising:

a mounting section on which a medium to be fed is mounted;

a feeding roller configured to feed the medium mounted on the mounting section;

a separation roller configured to nip and separate the medium with the feeding roller therebetween;

a regulation section disposed downstream of the nipping position between the feeding roller and the separation roller, the regulation section being disposed at a position different from the separation roller in an intersecting direction that intersects a medium feeding direction, and the regulation section being configured to regulate the contact of the medium to be fed and the separation roller, the regulation section including a fixed member that is not moved by the contact with a medium; and a supporting member that supports the separation roller and forms a medium feeding path, the fixed member being provided in the supporting member.

15. The medium feeding apparatus according to claim 14, wherein the fixed member is integrally provided with the supporting member.

16. An image reading apparatus comprising:

a reading section configured to read a medium; and the medium feeding apparatus according to claim 14 configured to transport the medium to the reading section.

17. A medium feeding apparatus comprising:

a mounting section on which a medium to be fed is mounted;

a feeding roller configured to feed the medium mounted on the mounting section;

a separation roller configured to nip and separate the medium with the feeding roller therebetween; and a regulation section disposed downstream of the nipping position between the feeding roller and the separation roller, the regulation section being disposed at a position different from the separation roller in an intersecting direction that intersects a medium feeding direction, and the regulation section being configured to regulate the contact of the medium to be fed and the separation roller, the regulation section being configured to be moved toward or away from the medium feeding path and moved toward or away from the medium feeding path depending on the medium type.

18. An image reading apparatus comprising:

a reading section configured to read a medium; and the medium feeding apparatus according to claim 17 configured to transport the medium to the reading section.

* * * * *